US006160531A

United States Patent [19]

Chen et al.

[11] Patent Number: 6,160,531

[45] Date of Patent: Dec. 12, 2000

[54] LOW LOSS DRIVING CIRCUIT FOR PLASMA DISPLAY PANEL

[75] Inventors: Chern-Lin Chen, Taipei; Song-Yi Lin, Hsien, both of Taiwan

[73] Assignee: Acer Display Technology, Inc., Hsinchu, Taiwan

[21] Appl. No.: 09/169,172

[22] Filed: Oct. 7, 1998

[51] Int. Cl.[7] ..... G09G 3/28

[52] U.S. Cl. ..... 345/60; 345/37; 345/69; 345/70

[58] Field of Search ..... 345/37, 60, 69, 345/70

[56] References Cited

U.S. PATENT DOCUMENTS 6,001,355 1/2000 Nagai ..... 315/167.3

*Primary Examiner*—Richard A. Hjerpe
*Assistant Examiner*—Kevin Nguyen
*Attorney, Agent, or Firm*—Winston Hsu

[57] ABSTRACT

The present invention discloses a driving method utilizing a driving circuit for driving a plasma display unit of a plasma display panel. The plasma display unit is repeatedly charged for sustaining an image signal. The driving circuit comprises an inductor connected in parallel to two ends of the plasma display unit, a power supply for charging the plasma display unit and the inductor, a first switch connected between the power supply and the first end of the plasma display unit, a second switch connected between the first end of the plasma display unit and ground, a third switch connected between the power supply and the second end of the plasma display unit, and a fourth switch connected between the second end of the plasma display unit and ground. Each of the first and second switches comprises a transistor having a parasitic diode between the drain and source of each transistor. Each switch is switched on only when the potential difference between the source and drain of the transistor is 0V.

20 Claims, 6 Drawing Sheets

LOW LOSS DRIVING CIRCUIT FOR PLASMA DISPLAY PANEL

BACKGROUND OF THE INVENTION

1. Field of the Invention

The present invention relates to a driving circuit for driving a plasma display unit, and more specifically, to a driving circuit with low energy loss while charging or discharging a plasma display unit.

2. Description of the Prior Art

Plasma display panel (PDP) has the advantages of large screen size, flat and thin structure, wide viewing angle and low radiation. Therefore, they are rapidly capturing the large-scale display panel market of the future. Plasma display panels work by charging the PDP with high voltage and high frequency alternating current (AC) thereby activating electrical charges in the plasma. During this process, ultraviolet rays bombard the phosphor on the wall and emit light. The plasma display panel behaves like a capacitor with alternating voltages applied on two electrodes. When the two electrodes of the PDP are suddenly short-circuited or charged by high voltage, an instantaneous large current will be generated which will cause electromagnetic interference and a great loss of energy. In order to reduce the instantaneous current, the driving circuit of a traditional plasma display panel uses an inductor to resonate with a capacitor to slow down the charging and discharging process of the plasma display panel. However, these driving circuits are very complicated and costly.

Please refer to FIG. 1. FIG. 1 is a schematic circuit diagram of a single-sided driving circuit 10 of a prior art plasma display unit. The single-sided driving circuit 10 is used for driving a plasma display unit 14. The plasma display unit 14 is represented by an equivalent capacitor $C_L$. The single-sided driving circuit 10 comprises a two-way switch 12, four transistors M1, M2, M5 and M6, two diodes D1 and D2, an inductor L, a high-capacity capacitor C1, and two DC power supplies V and $V_G$. The two-way switch 12 comprises two transistors M3, M4 and two zener diodes ZD1 and ZD2 for limiting voltages.

Please refer to FIG. 2. FIG. 2 shows timing diagrams of various nodes of the single-sided driving circuit in FIG. 1. Diagram A shows the potential of the input node A of the two-way switch 12. Diagram B shows the potential of the output node B of the two-way switch 12. Diagram C shows the potential of the gate of the transistor M1. Diagram D shows the potential of the gate of the transistor M2. Diagram E shows the potential of the gate of the transistor M5. Diagram F shows the potential of the gate of the transistor M6. Vo is the potential of the output port to the plasma display unit 14. Io is the current flowing through the plasma display unit 14. Since the transistors M1 and M5 are PMOS, the transistor M1 or M5 will be conducted if the gate of the transistor M1 or M5 is connected to low voltage, otherwise, the transistor M1 or M5 will be switched off. Since the transistors M2 and M6 are NMOS, the transistor M2 or M6 will be conducted if the gate of the transistor M2 or M6 is connected to high voltage, otherwise, the transistors M2 and M6 will be switchedoff. The control procedure shown by the timing diagrams of FIG. 2 is as followed:

step 1: before the time period T1, the potential Vo of the plasma display unit 14 is 0V, the transistors M2, M6 are conducting, and the transistors M1, M5 are switched off;

step 2: in the time period T1, the gate C of the transistor M1 and the gate D of transistor M2 will be applied with low voltage 22, thus the transistor M1 will be switched on and the transistor M2 will be switched off, the potential of node A will rise to $V_G$ for controlling the operation of the two-way switch 12, the potential of node B will rise to V/2. At this time, the inductor L will resonate with the plasma display unit 14, and the output potential Vo will subsequently be slowly charged to V;

step 3: in the time period T2, the gate C of transistor M1 and the gate D of the transistor M2 will be applied with high voltage 24, thus the transistor M2 will conduct and the transistor M1 will be switched off, the potential of A will drop to 0 to control the two-way switch 12, and the potential of B will rise to V due to the resonance. At this time, the output potential Vo is still at V. Because the potential difference between the drain and source of the transistor M5 approximates 0V, the parasitic diode between the drain and source conducts. In the time period T2, the gate E of the transistor M5 is applied with low potential 26 so as to switch on the transistor M5 with zero potential difference between its source and drain;

step 4: in the time period T3, the gate C of the transistor M1 and the gate D of the transistor M2 again drops to low potential 28 causing the transistor M1 to be switched on and the transistor M2 to be switched off, the potential of A to rise again with subsequent switching on of the two-way switch 12. This leads to the drop of the potential of node B to V/2 while the gate E of the transistor M5 is controlled at high potential to switch off the transistor M5. At this time, the inductor L starts to resonate with the plasma display unit 14, and the load capacitor $C_L$ will then be discharged slowly until the output potential Vo drops to 0V;

step 5: in the time period T4, the gate C of transistor M1 and the gate D of the transistor M2 is raised to high potential to switch off the transistor M1 and switch on the transistor M2, the potential of A will then drop to 0 and will switch off the two-way switch 12. At this time, the output potential Vo is still at 0V and the potential of node B will drop to 0V due to resonance. Since the potential difference between the drain and source of the transistor M6 approximates 0V, the parasitic diode will conduct. Also, at this time, the gate F of the transistor M6 rises to high potential 30 resulting in conduction of the transistor M6 so as to switch on the transistor M6 at zero voltage difference; and step 6: repeat step 2 to step 5 for continuous charging and discharging the plasma display unit 14.

Because the inductor L and load capacitor $C_L$ of the single-sided driving circuit 10 form a resonance circuit, the energy stored in the inductor L and the load capacitor $C_L$ will be mutually exchanged. By switching on either the transistors M5 or M6 when the output potential Vo has reached V or 0 respectively, a great amount of energy consumed by charging and discharging the load capacitor $C_L$ can be saved. Since each of the transistors M5 and M6 conducts when the potential difference between its drain and source is 0, it is called switching at zero voltage.

Please refer to FIG. 3. FIG. 3 is a circuit diagram of a double-sided driving circuit 40 formed by the single-sided driving circuit 10 in FIG. 1. The double-sided driving circuit 40 comprises two single-sided driving circuits 10 electrically connected to the two ends of the plasma display unit 14 for sustaining the display of image signals through continuous charging and discharging of the plasma display unit 14 by driving the plasma inside the plasma display unit 14 back and forth. Each of the two-way switches 42 of the double-sided driving circuit 40 comprises a two-way switch 12, transistors M1, M2, and a DC power supply $V_G$ of the driving circuit 10 shown in FIG. 1. The switches Qa and Qb comprise transistors M5 and M6. Because the double-sided driving circuit 40 has quite complicated components and requires the use of high-capacity capacitors C1, the double-sided driving circuit 40 is difficult to control and costly.

SUMMARY OF THE INVENTION

It is therefore a primary objective of the present invention to provide a driving circuit for a plasma display unit which has a simplified circuit design, and a reduced manufacturing cost provided the same function of energy recovery.

In a preferred embodiment, the present invention provides a driving method utilizing a driving circuit for driving a plasma display unit of a plasma display panel over which the plasma display unit can be repeatedly charged for sustaining an image signal, the plasma display unit comprising a first end and a second end, the driving circuit comprising an inductor connected in parallel to two ends of the plasma display unit, a power supply for charging the plasma display unit and the inductor, a first switch connected between the power supply and the first end of the plasma display unit, a second switch connected between the first end of the plasma display unit and a ground, a third switch connected between the power supply and the second end of the plasma display unit, and a fourth switch connected between the second end of the plasma display unit and the ground, each of the first and second switches comprising a transistor having a parasitic diode between the drain and source of each transistor; wherein when a current supplied by the power supply through the first switch, the inductor and the fourth switch reaches a predetermined value, the driving method comprising:

step(1) switching off the first switch so that the current of the inductor flows through the plasma display unit and decreases the potential at the first end of the plasma display unit until the parasitic diode of the second switch is conducted, and then conducting the second switch so that it is switched on at zero voltage;

step(2) switching off the fourth switch and conduct the third switch;

step(3) utilizing the power supply to charge the plasma display unit and the inductor via the third and second switches until the current of the inductor reaches a predetermined value;

step(4) switching off the second switch so that the current of the inductor flows through the plasma display unit and increases the potential at the first end of the plasma display unit until the parasitic diode of the first switch is conducted, and then conducting the first switch so that it is turned on at zero voltage;

step(5) switching off the third switch and conduct the fourth switch;

step(6) utilizing the power supply to charge the plasma display unit and the inductor via the first and fourth switches until the current of the inductor reaches a predetermined value; and step(7) repeating step(1) to step(6) to repeatedly charge the plasma display unit for sustaining the image signal display.

It is an advantage of the present invention that the driving circuit has a very simple circuit design, and uses fewer components. Furthermore, all the switches in the circuit are switched at zero voltage, thus the driving circuit saves a lot of energy and has a relatively low manufacturing cost.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 4:
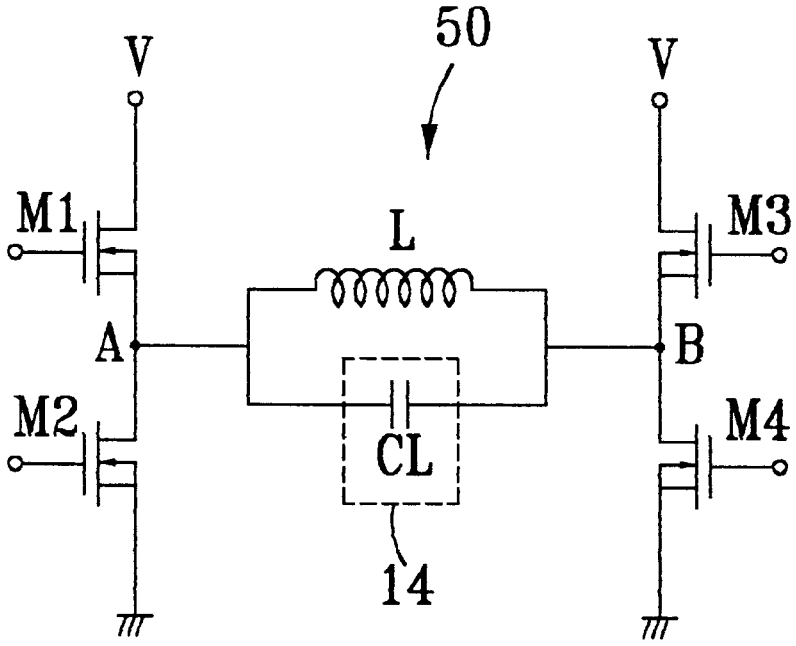
FIG. 4 is circuit diagram of a double-sided driving circuit of a plasma display unit according to the present invention.
Figure 5:
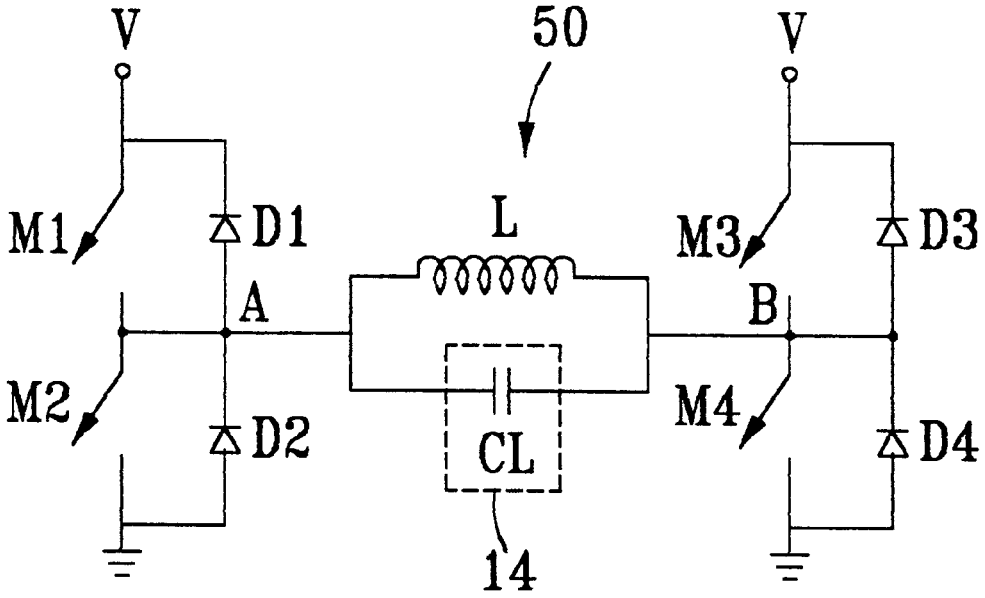
FIG. 5 is an equivalent circuit diagram of the double-sided driving circuit in FIG. 4.

Please refer to FIG. 4 and FIG. 5. FIG. 4 is circuit diagram of a double-sided driving circuit 50 of a plasma display unit according to the present invention. FIG. 5 is an equivalent circuit diagram of the double-sided driving circuit 50. The driving circuit 50 is used for driving a plasma display unit 14. The plasma display unit 14 can be represented by a load capacitor $C_L$ which is repeatedly charged for sustaining the display of image signals. The driving circuit 50 comprises an inductor L connected in parallel to two ends of the plasma display unit 14, a power supply V used for charging the plasma display unit 14 and the inductor L, a first switch M1 connected between the power supply V and the first end A of the plasma display unit 14, a second switch M2 connected between the first end A of the plasma display unit 14 and ground, a third switch M3 connected between the power supply V and the second end B of the plasma display unit 14, a fourth switch M4 connected between the second end B of the plasma display unit 14 and ground, and a control circuit (not shown) for controlling the four switches M1, M2, M3 and M4. Each of the switches M1, M2, M3 and M4 comprises a MOS (metal oxide semiconductor) transistor having a parasitic diode between the drain and source of each transistor. The parasitic diodes of the four transistors are represented by diodes D1, D2, D3 and D4 in FIG. 5. The drains of the transistors M1 and M3 are connected to the power source V, and the sources of the transistors M2 and M4 are connected to ground.

Figure 6:
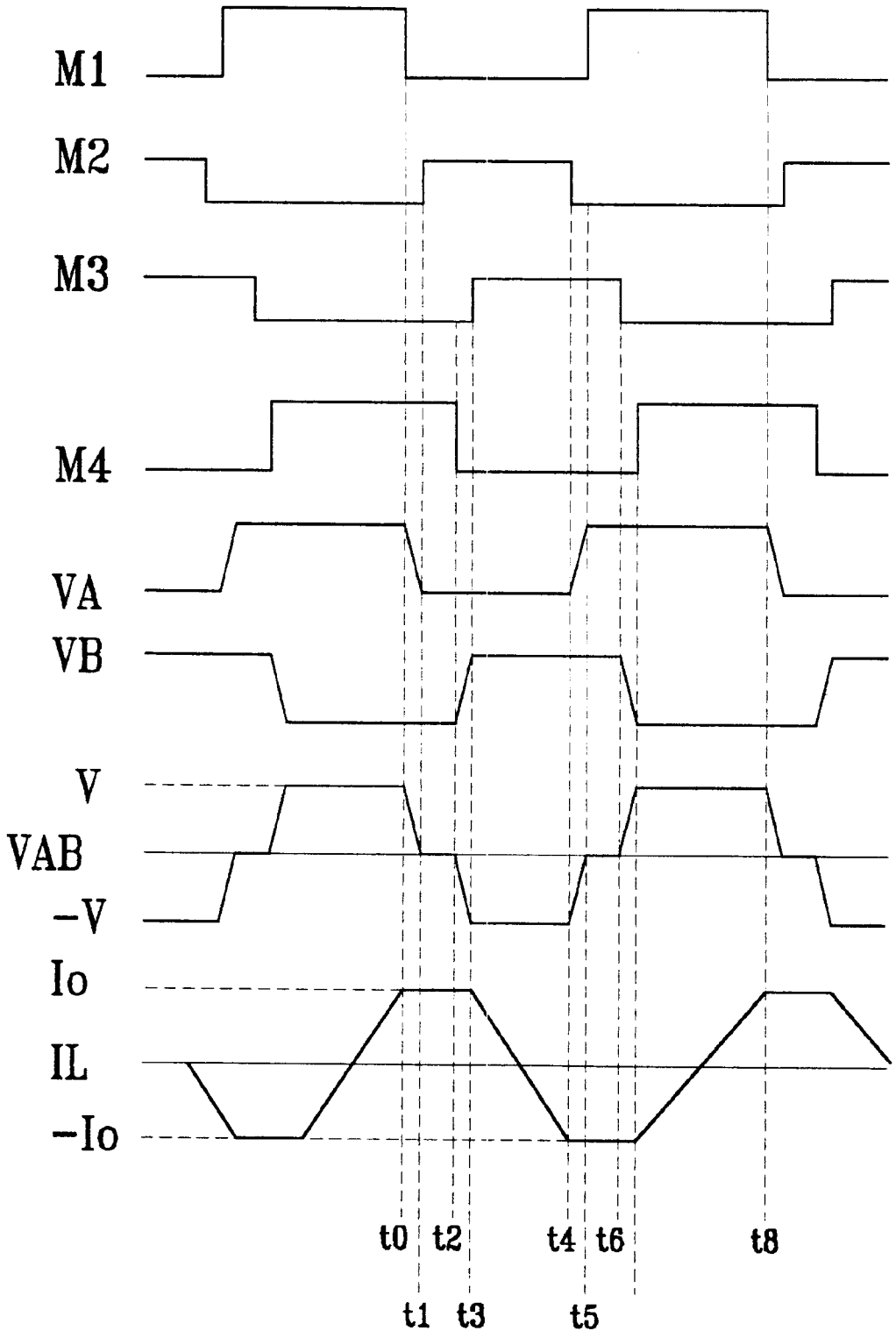
FIG. 6 is a timing diagram of the driving circuit in FIG. 5.

Please refer to FIG. 6. FIG. 6 is a timing diagram of the driving circuit 50 in FIG. 5. M1 is the control signal of the transistor M1. M2 is the control signal of the transistor M2. M3 is the control signal of the transistor M3. M4 is the control signal of the transistor M4. The control signals M1, M2, M3 and M4 are potential differences between the gate and source of each transistor outputted by the control circuit for controlling the operation of the transistors M1, M2, M3 and M4. When the potential difference is high, the transistor is switched on. When the potential difference is low, the transistor is switched off. $V_A$ is the potential of A end of the plasma display unit 14. $V_B$ is the potential of B end of the plasma display unit 14. $V_{AB}$ is the potential difference of the plasma display unit 14 over its two ends. $I_L$ is the current flowing through the inductor L. The control procedure of the control circuit is as follows:

step 1: before time t0, the control circuit switches on the first switch M1 and the fourth switch M4 so that the power supply V can charge the plasma display unit 14. At this time, the potential $V_{AB}$ of the plasma display unit 14 over its two ends is V, and the current $I_L$ of the parallel inductor L increases linearly until reaching a predetermined value $I_0$;

step 2: at time t0, switch off the first switch M1 so that the current $I_L$ of the inductor L will flow through the plasma display unit 14 and the potential $V_A$ at node A will drop roughly linearly until the parasitic diode D2 of the second switch M2 is conducted. At this time, the current $I_L$ of the inductor L will flow through the parasitic diode D2;

step 3: at time t1, conduct the second switch M2 to switch on the switch M2 at zero voltage;

step 4: at time t2, switch off the fourth switch M4 so that the current $I_L$ of the inductor L can flow through the plasma display unit 14 and the potential $V_B$ at B end of the plasma display unit 14 will increase linearly until the parasitic diode D3 of the third switch M3 is conducted. At this time, the current $I_L$ of the inductor L starts to flow through the parasitic diode D3;

step 5: at time t3, conduct the third switch M3 to switch on the switch M3 at zero voltage so that the power supply V can charge the plasma display unit 14 and inductor L by the third switch M3 and the second switch M2 until the current $I_L$ of the inductor L reaches a predetermined value $-I_0$;

step 6: at time t4, switch off the second switch M2 so that the current $I_L$ of the inductor L can flow through the plasma display unit 14 and increase the potential $V_A$ at A end of the plasma display unit 14 until the parasitic diode D1 of the first switch M1 is conducted. At this time, the current $I_L$ of the inductor L starts to flow through the parasitic diode D1;

step 7: at time t5, conduct the first switch M1 to switch on the switch M1 at zero voltage;

step 8: at time t6, switch off the third switch M3 so that the current $I_L$ of the inductor L can flow through the plasma display unit 14 and decrease the potential $V_B$ at B end of the plasma display unit 14 until the parasitic diode D4 of the fourth switch M4 is conducted. At this time, the current $I_L$ of the inductor L starts to flow through the parasitic diode D4;

step 9: at time t7, conduct the fourth switch M4 to switch on the switch M4 at zero voltage; at this time, the power supply V will charge the plasma display unit 14 and the inductor L by the first switch M1 and the fourth switch M4 until the current $I_L$ of the inductor L reaches a predetermined value $I_0$; and step 10: repeat step 2 to step 9 to repeatedly charge the plasma display unit 14 for sustaining the image signal display.

In the aforementioned control procedure, the control circuit switches off the first switch M1 and conducts the second switch M2 to ground A end of the plasma display unit 14 at time t0 and t1, and then switches off the fourth switch M4 and conducts the third switch M3 for connecting B end of the plasma display unit 14 to the power supply V at time t2 and t3. These two steps can be swapped by having the control circuit connect node B of the plasma display unit 14 to the power supply V first and then ground node A of the plasma display unit 14. For the same reason, steps for connecting node A to the power supply V at time t4 and t5 can also be swapped with steps for connecting node B to the ground at time t6 and t7. The swap will neither affect the charging and discharging process of the plasma display unit 14 nor cause energy loss as long as the switches are switched at zero voltage.

In FIG. 6, during the time period t0 to t3 or time period t4 to t7, the voltage $V_{AB}$ of the plasma display unit 14 is changed from V to −V or from −V to V. This voltage changing period can be represented by $T_D$. During the time period t3 to t4 or t7 to t8, the voltage $V_{AB}$ of the plasma display unit 14 is sustained at −V or V. This period is called a charging period and can be represented by $T_C$. When designing the driving circuit 50, the charging period $T_C$ and voltage changing period $T_D$ can be determined according to the switch frequency of the plasma display unit 14. During the charging period, $I_0$ can be derived according to the characteristic equation $V=Ld(I_L)/dt$:

$$2I_0=VT_C/L \tag{1}$$

During the voltage changing period, if the inductor L has great inductance satisfying $L*I_L^2>>C*V_{AB}^2$, the current $I_L$ generated by the inductor L during the voltage changing period can roughly be treated as a constant $I_0$. The voltage changing period $T_D$ can be derived according to the characteristic equation $I_L=C*d(V_{AB})/dt$:

$$T_D=C*V/I_0 \tag{2}$$

Since the power supply V and the capacitance C of the plasma display unit 14 are known, the current $I_0$ can be derived by equation (2). Also, the inductance L can be derived by using equation (1).

Figure 1:
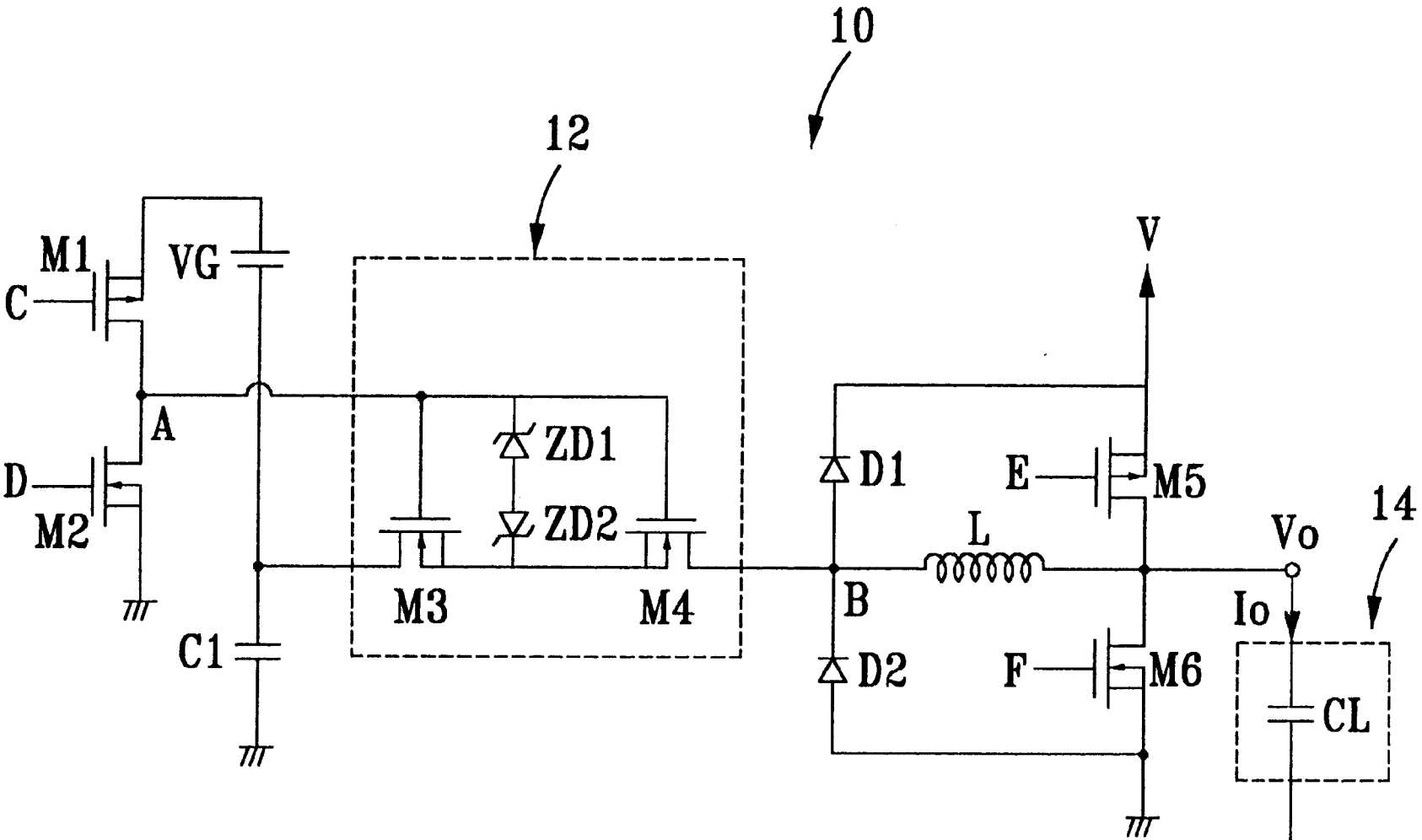
FIG. 1 PRIOR ART
FIG. 1 is a circuit diagram of a single-sided driving circuit of a prior art plasma display unit.
Figure 2:
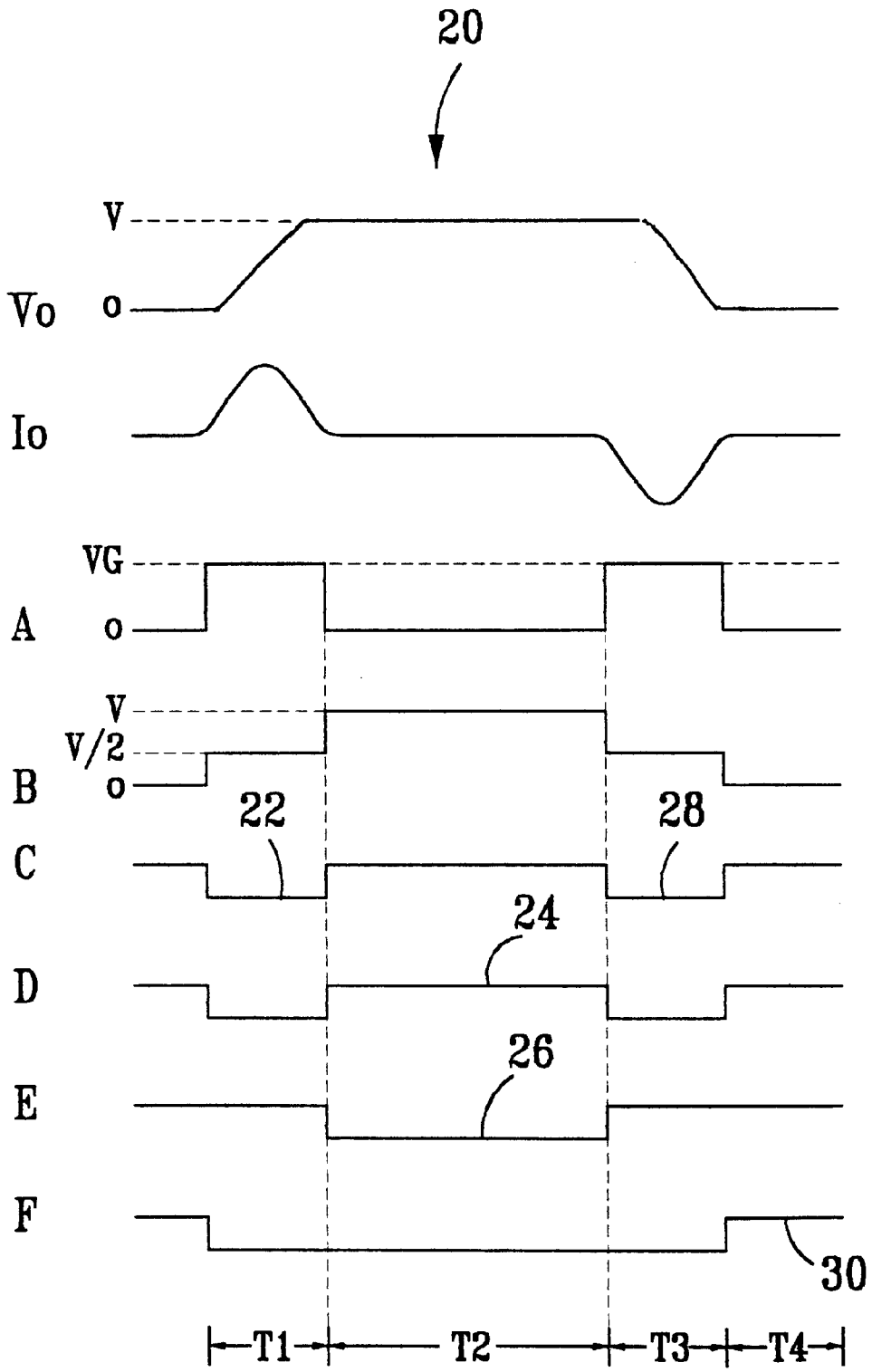
FIG. 2 PRIOR ART
FIG. 2 is a timing diagram of the single-sided driving circuit in FIG. 1.
Figure 3:
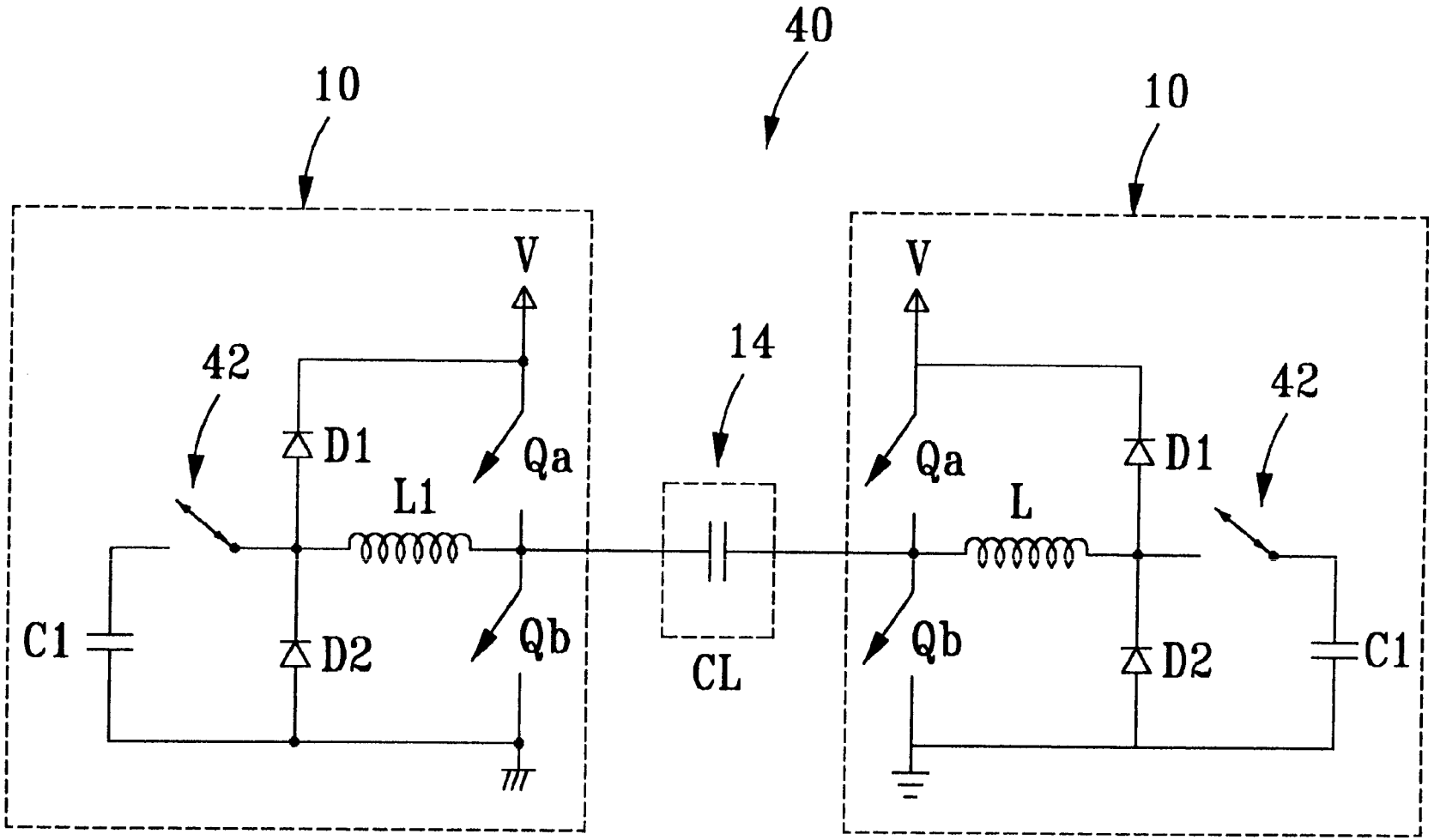
FIG. 3 is a circuit diagram of a double-sided driving circuit formed by the single-sided driving circuit in FIG. 1.

The driving circuit 50 in FIG. 4 is far simpler and uses far less components when compared to the driving circuit 40 in FIG. 3. Therefore, power consumption and manufacturing costs of the driving circuit 50 are much lower than that of the driving circuit 40.

Figure 7:
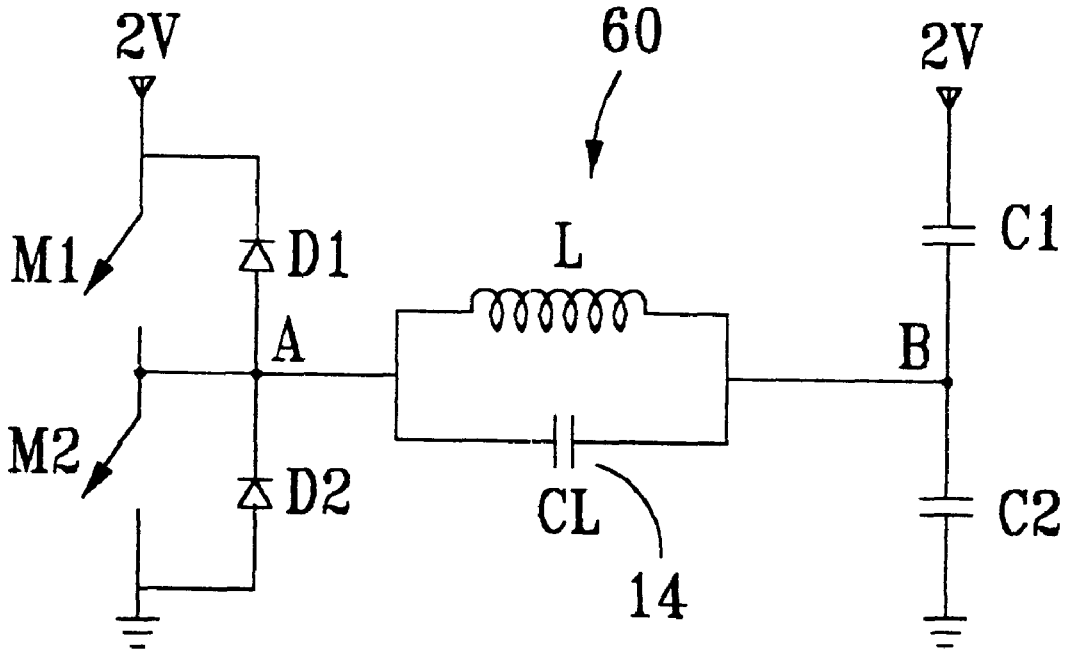
FIG. 7 is an alternative driving circuit according to the present invention.

Please refer to FIG. 7. FIG. 7 shows an alternative driving circuit 60 according to the present invention. The difference between the driving circuit 60 and the driving circuit 50 shown in FIG. 6 is that the switches M3 and M4 of the driving circuit 50 are replaced by two equal capacitors C1 and C2 in the driving circuit 60. Moreover, the power supply of the driving circuit 60 is changed to 2V for sustaining the potential $V_{AB}$ of the plasma display unit 14 at V or −V. The capacitors C1 and C2 form a voltage dividing circuit which sustains the potential at B end of the plasma display unit 14 at V. The control procedure of the driving circuit 60 is as following:

step 1: conduct a first switch M1 and switch off a second switch M2 so that the power supply 2V can charge the plasma display unit 14; at this time, the voltage $V_{AB}$ at two nodes of the plasma display unit 14 becomes V, and the current $I_L$ of the parallel inductor L will increase linearly; the power supply 2V will raise the current $I_L$ flowing through the inductor L to a predetermined value $I_0$ by using the first switch M1 and the capacitor C2;

step 2: switch off the first switch M1 so that the current $I_L$ of the inductor L starts to flow through the plasma display unit 14 and decreases the potential $V_A$ at node A of the plasma display unit 14 until the parasitic diode D2 of the second switch M2 is conducted, conduct the second switch M2 to switch on the switch M2 at zero voltage;

step 3: use the power supply 2V to charge the plasma display unit 14 and the inductor L by using the capacitor C1 until the current $I_L$ of the inductor L reaches a predetermined value $-I_0$;

step 4: switch off the second switch M2 so that the current $I_L$ of the inductor L can start to flow through the plasma display unit 14 and raise the potential $V_A$ at node A of the plasma display unit 14 until the parasitic diode D1 of the first switch M1 is conducted, conduct the first switch M1 to switch on the switch M1 at zero voltage;

step 5: charge the plasma display unit 14 and the inductor L by using the power supply 2V until the current $I_L$ of the inductor L reaches a predetermined value $I_0$; and step 6: repeat step 2 to 5 to repeatedly charge the plasma display unit 14 for sustaining the image signal display.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A driving method utilizing a driving circuit for driving a plasma display unit of a plasma display panel over which the plasma display unit can be repeatedly charged for sustaining an image signal, the plasma display unit comprising a first end and a second end, the driving circuit comprising an inductor connected in parallel to the two ends of the plasma display unit, a power supply for charging the plasma display unit and the inductor, a first switch connected between the power supply and the first end of the plasma display unit, a second switch connected between the first end of the plasma display unit and a ground, a third switch connected between the power supply and the second end of the plasma display unit, and a fourth switch connected between the second end of the plasma display unit and the ground, each of the first and second switches comprising a transistor having a parasitic diode between the drain and source of each transistor; wherein when a current supplied by the power supply through the first switch, the inductor and the fourth switch reaches a predetermined value, the driving method comprising:

step(1) switching off the first switch so that the current of the inductor flows through the plasma display unit and decreases the potential at the first end of the plasma display unit until the parasitic diode of the second switch is conducted, and then conducting the second switch so that it is switched on at zero voltage;

step(2) switching off the fourth switch and conducting the third switch;

step(3) utilizing the power supply to charge the plasma display unit and the inductor via the third and second switches until the current of the inductor reaches a predetermined value;

step(4) switching off the second switch so that the current of the inductor flows through the plasma display unit and increases the potential at the first end of the plasma display unit until the parasitic diode of the first switch is conducted, and then conducting the first switch so that it is switched on at zero voltage;

step(5) switching off the third switch and conduct the fourth switch;

step(6) utilizing the power supply to charge the plasma display unit and the inductor via the first and fourth switches until the current of the inductor reaches a predetermined value; and step(7) repeating step(1) to step(6) to repeatedly charge the plasma display unit for sustaining the image signal display.

2. The driving method of claim 1 wherein the first or second switch can be a MOS (metal oxide semiconductor) transistor.

3. The driving method of claim 1 wherein the third switch comprises a transistor having a parasitic diode between the drain and source of the transistor, and wherein, in step(2) of the driving method, when the fourth switch is switched off, the current of the inductor will flow through the plasma display unit and increase the potential at the second end of the plasma display unit until the parasitic diode of the third switch is conducted, after which the third switch is conducted so that it is switched on at zero voltage.

4. The driving method of claim 3 wherein the third switch can be a MOS transistor.

5. The driving method of claim 1 wherein the fourth switch comprises a transistor having a parasitic diode between the drain and source of the transistor, and wherein, in step(5) of the driving method, when the third switch is switched off, the current of the inductor will flow through the plasma display unit and decrease the potential at the second end of the plasma display unit until the parasitic diode of the fourth switch is conducted, after which the fourth switch is conducted so that it is switched on at zero voltage.

6. The driving method of claim 5 wherein the fourth switch can be a MOS transistor.

7. A driving circuit for driving a plasma display unit of a plasma display panel over which the plasma display unit can be repeatedly charged for sustaining an image signal, the plasma display unit comprising a first end and a second end, the driving circuit comprising an inductor connected in parallel to the two ends of the plasma display unit, a power supply for charging the plasma display unit and the inductor, a first switch connected between the power supply and the first end of the plasma display unit, a second switch connected between the first end of the plasma display unit and a ground, a third switch connected between the power supply and the second end of the plasma display unit, a fourth switch connected between the second end of the plasma display unit and a ground, and a control circuit for controlling the first, second, third and fourth switches, each of the first and second switches comprising a transistor having a parasitic diode between the drain and source of each transistor; wherein when a current supplied by the power supply through the first switch, the inductor and the fourth switch reaches a predetermined value, the control circuit will:

step(1) switch off the first switch to allow the current of the inductor to flow through the plasma display unit and decrease the potential at the first end of the plasma display unit until the parasitic diode of the second switch is conducted, and then conduct the second switch so that it is switched on at zero voltage;

step(2) switch off the fourth switch and conduct the third switch;

step(3) utilize the power supply to charge the plasma display unit and the inductor via the third and second switches until the current of the inductor reaches a predetermined value;

step(4) switch off the second switch to allow the current of the inductor to flow through the plasma display unit and increase the potential at the first end of the plasma display unit until the parasitic diode of the first switch is conducted, and then conduct the first switch so that it is switched on at zero voltage;

step(5) switch off the third switch and conduct the fourth switch;

step(6) utilize the power supply to charge the plasma display unit and the inductor via the first and fourth switches until the current of the inductor reaches a predetermined value; and step(7) repeat step(1) to step(6) to repeatedly charge the plasma display unit for sustaining the image signal display.

8. The driving circuit of claim 7 wherein the first or second switch can be a MOS transistor.

9. The driving circuit of claim 7 wherein the third switch comprises a transistor having a parasitic diode between the drain and source of the transistor, and wherein when the driving circuit switches off the fourth switch in step(2), the current of the inductor will flow through the plasma display unit and increase the potential at the second end of the plasma display unit until the parasitic diode of the third switch is conducted, and then the driving circuit will conduct the third switch to switch on the third switch at zero voltage.

10. The driving circuit of claim 9 wherein the third switch can be a MOS transistor.

11. The driving circuit of claim 7 wherein the fourth switch comprises a transistor having a parasitic diode between the drain and source of the transistor, and wherein when the driving circuit switches off the third switch in step(5), the current of the inductor will flow through the plasma display unit and decrease the potential at the second end of the plasma display unit until the parasitic diode of the fourth switch is conducted, then the driving circuit will conduct the fourth switch to switch on the fourth switch at zero voltage.

12. The driving circuit of claim 11 wherein the fourth switch can be a MOS transistor.

13. A driving method utilizing a driving circuit for driving a plasma display unit of a plasma display panel over which the plasma display unit can be repeatedly charged for sustaining an image signal, the plasma display unit comprising a first end and a second end, the driving circuit comprising an inductor connected in parallel to two ends of the plasma display unit, a power supply for charging the plasma display unit and the inductor, a first switch connected between the power supply and the first end of the plasma display unit, a second switch connected between the first end of the plasma display unit and a ground, and a voltage dividing circuit connected to the power supply and the second end of the plasma display unit for reducing the potential at the second end of the plasma display unit thereby maintaining the potential between the power supply and the ground, each of the first and second switches comprising a transistor having a parasitic diode between the drain and source of each transistor; wherein when a current supplied by the power supply through the first switch, the inductor and the voltage dividing circuit reaches a predetermined value, the driving method comprising:

step(1) switching off the first switch to enable the current of the inductor to flow through the plasma display unit and decrease the potential at the first end of the plasma display unit until the parasitic diode of the second switch is conducted, and then conducting the second switch so that it is switched on at zero voltage;

step(2) utilizing the power source to charge the plasma display unit and the inductor by the voltage dividing circuit until the current of the inductor reaches a predetermined value;

step(3) switching off the second switch to enable the current of the inductor to flow through the plasma display unit and increase the potential at the first end of the plasma display unit until the parasitic diode of the first switch is conducted, and then conducting the first switch so that it is switched on at zero voltage;

step(4) utilizing the power supply to charge the plasma display unit and the inductor until the current of the inductor reaches a predetermined value; and step(5) repeating step(1) to step(4) to repeatedly charge the plasma display unit for sustaining the image signal display.

14. The driving method of claim 13 wherein the first or second switch can be a MOS transistor.

15. The driving method of claim 13 wherein the voltage dividing circuit comprises a first capacitor connected between the power supply and the second end of the plasma display unit, and a second capacitor connected between the second end of the plasma display unit and the ground.

16. The driving method of claim 15 wherein the capacitance of the first capacitor is approximately equal to the capacitance of the second capacitor so that the potential at the second end of the plasma display unit is approximately half of the potential difference between the power supply and the ground.

17. A driving circuit for driving a plasma display unit of a plasma display panel over which the plasma display unit can be repeatedly charged for sustaining an image signal, the plasma display unit comprising a first end and a second end, the driving circuit comprising an inductor connected in parallel to two ends of the plasma display unit, a power supply for charging the plasma display unit and the inductor, a first switch connected between the power supply and the first end of the plasma display unit, a second switch connected between the first end of the plasma display unit and a ground, a voltage dividing circuit connected to the power supply and the second end of the plasma display unit for reducing the potential at the second end of the plasma display unit thereby maintaining the potential between the power supply and the ground, and a control circuit for controlling the first and second switches, each of the first and second switches comprising a transistor having a parasitic diode between the drain and source of each transistor; wherein when a current supplied by the power supply through the first switch, the inductor and the voltage dividing circuit reaches a predetermined value, the control circuit will:

step(1) switch off the first switch to enable the current of the inductor to flow through the plasma display unit and decrease the potential at the first end of the plasma display unit until the parasitic diode of the second switch is conducted, and the conduct the second switch so that it is switched on at zero voltage;

step(2) utilize the power source to charge the plasma display unit and the inductor by the voltage dividing circuit until the current of the inductor reaches a predetermined value;

step(3) switch off the second switch to enable the current of the inductor to flow through the plasma display unit and increase the potential at the first end of the plasma display unit until the parasitic diode of the first switch is conducted, and then conduct the first switch so that it is switched on at zero voltage;

step(4) utilize the power supply to charge the plasma display unit and the inductor until the current of the inductor reaches a predetermined value; and step(5) repeat step(1) to step(4) to repeatedly charge the plasma display unit for sustaining the image signal display.

18. The driving circuit of claim 17 wherein the first or second switch can be a MOS transistor.

19. The driving circuit of claim 17 wherein the voltage dividing circuit comprises a first capacitor connected between the power supply and the second end of the plasma display unit, and a second capacitor connected between the second end of the plasma display unit and the ground.

20. The driving circuit of claim 19 wherein the capacitance of the first capacitor is similar to the capacitance of the second capacitor so that the potential at the second end of the plasma display unit is approximately half of the potential difference between the power supply and ground.

* * * * *